US005397128A

United States Patent [19]

Hesse et al.

[11] Patent Number: 5,397,128

[45] Date of Patent: Mar. 14, 1995

[54] CASINO CARD GAME

[76] Inventors: Michael A. Hesse, 2533 Three Springs Dr., Westlake Village, Calif. 91361; Vincent A. Oliver, 724 Fifth St., Hermosa Beach, Calif. 90254

[21] Appl. No.: 287,356

[22] Filed: Aug. 8, 1994

[51] Int. Cl.[6] ..... A63F 1/00

[52] U.S. Cl. ..... 273/292; 273/274

[58] Field of Search ..... 273/292, 293, 303, 306, 273/274

[56] References Cited

U.S. PATENT DOCUMENTS

| | | | |
|---|---|---|---|
| 4,346,897 | 8/1982 | Sisak | 273/292 X |
| 4,955,619 | 9/1990 | Christman | 273/303 X |
| 5,067,724 | 11/1991 | Rinkavage | 273/292 |
| 5,125,667 | 6/1992 | Richards | 273/292 X |
| 5,141,234 | 8/1992 | Boylan et al. | 273/303 X |
| 5,213,334 | 5/1993 | Yih | 273/292 |
| 5,242,171 | 9/1993 | Hata | 273/292 |
| 5,314,193 | 5/1994 | Ferrer | 273/292 |
| 5,328,189 | 7/1994 | Malek | 273/292 |

FOREIGN PATENT DOCUMENTS

| | | | |
|---|---|---|---|
| 2129693 | 5/1984 | United Kingdom | 273/292 |

*Primary Examiner*—William E. Stoll
*Attorney, Agent, or Firm*—Edward E. Roberts

[57] ABSTRACT

A casino card game in which cards are dealt on a playing surface, by a dealer to players, the playing surface having indicia or symbols, on which the players place their bets, with other symbols denoting collection positions for the house. The deck of cards includes numbered cards 2 through 6 and 9 along with the honor cards Ace, King, Queen, jack. The King, Queen and jack effectively have zero value, the Ace a value of "one" and the other numbered cards have the face numerical value. A dealer deals each of the players three cards, face up, with the objective being to hit a 9 in total count or value. A banker is selected and the banker receives two cards face up and one card down. Wagering is effected against the bank wager of the banker, with payment of wagers processed against the bank in accordance with a pre-selected order obtained by the throw of dice prior to the onset of the game. Additional cards may be drawn at the option of the player subsequent to the opening deal, in the hopes of obtaining a better value. The player has the options of surrender, in which event he retains one-half his bet, or double by adding an increment of bet up to the original bet, and drawing an additional card. The game includes a two-tiered jakpot wherein one jackpot amount is paid when a player has three 3's of the same suit as his first three cards and a larger amount when the banker also has a hand value of nine on his first three cards.

28 Claims, 2 Drawing Sheets

CASINO CARD GAME

BACKGROUND OF THE INVENTION

This invention relates to card games and more particularly to a card game for a gambling casino.

In casino card games, such as for instance BLACKJACK, or 21, the cards are dealt by the dealer employed by the house to from one to six (or more) players, including the dealer. The cards are dealt from a stack of cards which may include one or more standard card decks of fifty-two cards, a deck consisting of ace through king of four different suits (i.e., spades , hearts, clubs and diamonds). In any case, the number of cards of a given face value are the same as the number of cards of any other face value, that is, in a four deck stack there are four aces of hearts, four tens of spades, etc.

On commencement of play, each player places a wager on the table, usually in the form of one or more chips of a given dollar value, with the amount of the wager being determined by house rules or limits. The dealer deals herself and each player two cards, the first card face down and the second card face up, with the objective being to beat the dealer. Each player, in sequence, is then given the option of being dealt one or more cards, face up. This option exists for one pass through the players.

Each numbered card has the face value of the number. Kings, Queens and Jacks count as ten each, while the value of the ace is optionally either eleven or one. Thus, in the game of blackjack, an ace and a ten (or any face card) provides the player (or the dealer) with "blackjack" (twenty-one based on two cards, one of which is the face down card). If the dealer deals herself a twenty-one, she immediately turns over the cards, and all players lose, except those with a two card twenty-one, who tie (and thus do not lose their wager). Absent the dealer hitting "blackjack", if one is dealt twenty-one or less, the player is still in the game. If a player exceeds twenty-one total points during play, the player "busts" and declares it as such, and loses the amount wagered.

If the player has a total, including the "hole" card (the face down card) of twenty-one or less, the player must then beat the dealer. If the dealer draws and busts, each remaining player then beats the dealer. While there are other variables in blackjack, these are the basic plays.

Wagering is commenced prior to the start of the deal, although under limited circumstances, additional wagering is permitted during play, as for example when a player may "double down". The details of these wagers need not be explained for the purpose of the background of casino card games. In any event, during play of blackjack and similar games, the cards are dealt in front of the player who must have access to the cards for the purpose of enabling viewing of the face down card prior to making a decision to "stand" or "hit" or "double down" or whatever. This handling of the cards by the players results in bending or soiling of the cards, slows down the game, and also provides an opportunity for a dishonest player to mark the cards.

In blackjack, for a single deck, there are fifty-two cards, twelve of which are face cards, and thus with the four tens, there are sixteen of the fifty-two cards having a numerical value of ten. Thus, the chances are 52/16 or 1 in 3.25 of drawing a card with a numerical value of ten on a deal of a single card. For the cards with a value of 2 to 9, the chances are the same, that is 1 out of 13 for a given numerical value. Although the odds of drawing an ace are the same as the 2 to 9 cards, the value can be one or eleven, which adds intrigue to the game if drawn after the initial two cards have been dealt. As cards are dealt, one-half are face up, which assist a player in deciding whether to draw another card based on the visible card values.

In blackjack, the dealer represents the "house", deals cards to herself, and player bets are made against the house, or dealer. As in all casino games, certain "house rules" are in effect, such as when the dealer must "stand" (not draw any cards) or not. In this way, the odds in favor of the player (or the house) can be managed or enhanced.

In certain states, gambling of only a limited sort is permitted. In California, for instance, while some gambling is allowed, certain types of games are illegal. A key feature of the California law is that games where the player bets against the house (or casino) are illegal. Players may bet against each other, but the card room or casino may not have a stake in any wager. The card room or casino may provide a place for the game and even have a house dealer who deals out hands and settles the wagers for the players. Unlike a Nevada casino, a California casino never wins or loses a wager.

The card rooms and casinos in states such as California, make their money by charging "collections". The casino provides the room, the gaming tables, the chairs for the players, and oftentimes, the dealer. The collection is a fee for running the game. Each player pays a fixed amount for the right to play. The collection is collected either for each hand or for a given time period, such as for each half hour. The size of the collection will usually depend on the particular game played and the limits of the table. For instance, a poker game where the largest bet allowed is $150.00 may charge $10 each half hour, whereas a game with a $100 limit on bets might charge $1 per hand played.

In many games played in California, one of the players is designated the "banker" on each hand. All other players are trying to beat the banker. If any other player beats the banker, (s)he wins the bet. If any player loses to the banker, (s)he loses his/her bet.

The opportunity to be banker rotates. Each player is offered the opportunity to be the banker. After two hands, the opportunity passes to the next player, who may choose to banker or refuse. The banker typically bets a relatively large amount of money on each hand, since the banker may have to cover bets placed by other players. This bet is called the "bank".

The banker is not required to bet enough money to cover all the bets made by other players. For example, six players may bet $100 each and the banker may only bet $500. It is possible that there may not be enough money to pay off one of the players. To handle this situation, each player's bet will only be at risk and (s)he will only have the opportunity to win, if there is enough money to cover that bet. The basic rule is that when a bet is paid, the amount at risk in the bank is reduced by the amount of the payoff. The following example of the process should serve to explain the procedures.

EXAMPLE

Suppose the "bank" has a pot of $400, each player has bet $100, and the following bets are made by each player with the accompanying result:

| | | |
|---|---|---|
| Player 1 | $100 | Win |
| Player 2 | $100 | Lose |
| Player 3 | $100 | Push (Tie) |
| Player 4 | $100 | Win |
| Player 5 | $100 | Win |
| Player 6 | $100 | Lose |
| Player 7 | $100 | Win |

After all the bets are placed, three dice are rolled to determine the order in which the bets are settled. For this example, we assume that Player 1's bet gets settled first. Since Player 1 wins, he is paid $100 from the bank. There is $300 left at risk in the bank. Since Player 2 loses, the banker wins the Player 2's $100 and the banker gets $100 of the bank. There is now $200 left at risk in the bank.

Player 3 and the bank have tied ("pushed") and no money changes hands. There is still $200 at risk in the bank. Players 4 and 5 each win and are paid $100 each from the bank. The bank has no money left at risk. Player 6 loses to the bank, but there is no money in the bank to cover his bet, so he gets to keep his money. Similarly Player 7 does not win anything. Both Players 6 and 7 are given a button for a free play on a future hand with no collection required.

Some players like to bet, but do not want to play a hand. They prefer to bet on another player's hand. These players are called "backline players." (This is similar to craps, where players who are not rolling the dice bet on the outcome). A player who bets on a hand without playing it, is said to be making a "backline bet". The backline bettors normally stand behind a seated player who makes the playing decisions for the hand being played.

The chairs at the gaming table are taken on a first-come, first-served basis. If there is a chair available, anyone may sit down and play. However, they may also stand behind a player and make backline bets. Each game has a limit to how many players make backline bets on each hand.

In casinos, be they in Nevada or other states, the amount collected (or won) by the house, is, in large part determined by factors other than the number of players. Such factors include the number of hands which can be played in a given amount of time. This, in turn, is determined by whether an automatic card shuffler can be employed, by whether the players are handling the cards (in which event, decks have to be replaced often), and by whether the game is such that the players spend a lot of time making decisions as to the next move they make.

SUMMARY OF THE INVENTION

In accordance with the present invention, there is provided a casino card game of "Ultra 9," in which cards are dealt on a playing surface, by a dealer to players. In practice, the playing surface has indicia or symbols, on which the players place their bets, with other symbols denoting collection positions for the house. The deck of cards includes numbered cards 2 through 6 and 9 along with the honor cards Ace, King, Queen, Jack. The King, Queen and Jack effectively have "zero" value, the Ace a value of "one and the other numbered cards have the face numerical value.

A dealer, on opening, deals each of the players three cards, face up, with the objective being to hit a "9" in total count or value. These cards are dealt out of reach of the players. A banker is selected prior to play and the banker receives two cards face up, and one card face down.

Wagering is effected against the "bank" wager of the banker, with payment of wagers processed against the bank in accordance with a pre-selected order obtained by the throw of dice prior to the onset of the deal. Additional cards may be drawn at the option of the player subsequent to the opening deal, in the hopes of obtaining a better value. The game lends itself to use of automatic card shufflers, and variations of jackpots. The objective is for the player to obtain a total value of nine or less during play.

Other objects, features and advantages of the invention will become apparent on a reading of the specification when taken in conjunction with the drawings, in which like reference numerals refer to like elements in the several views.

DESCRIPTION OF THE PREFERRED EMBODIMENT

Figure 1:
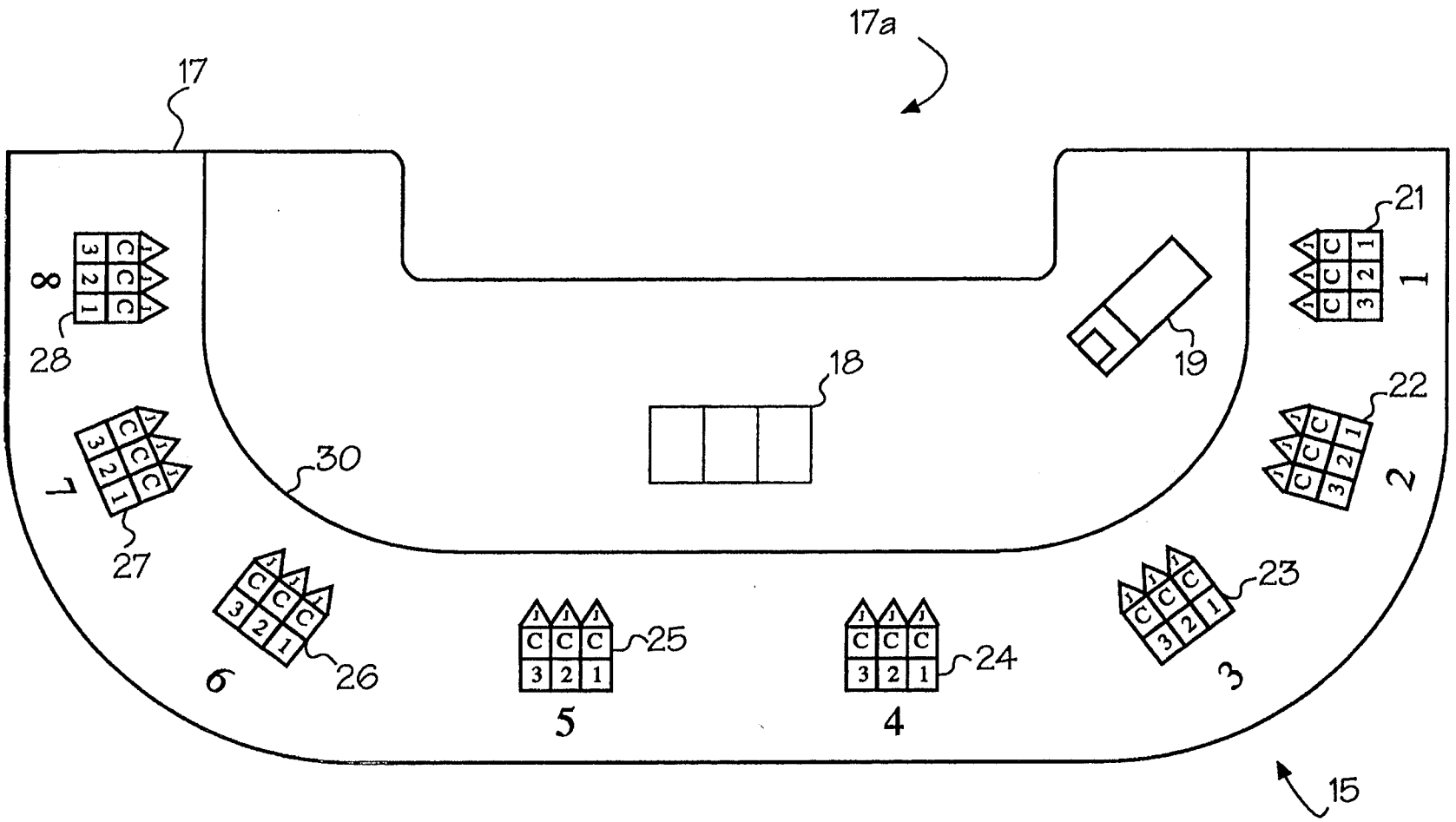
FIG. 1 is a plan view of a card playing surface for the card game according to the invention.

Referring now to the drawings, and particularly to FIG. 1, there is shown a playing surface, or table, generally designated 15, of somewhat semi-circular plan configuration, with playing positions, designated "1" through "8." The table 15 has a linear edge 17 with a center rectangular-blocked position 17*a*, which is the dealer position. The three part rectangle 18, in front of the dealer position 17*a*, represents the location for the banker to display the cards received by him. The card deck dispenser (or "shoe") 19, is shown located proximate the edge 17 to the left of the dealer.

Figure 2:
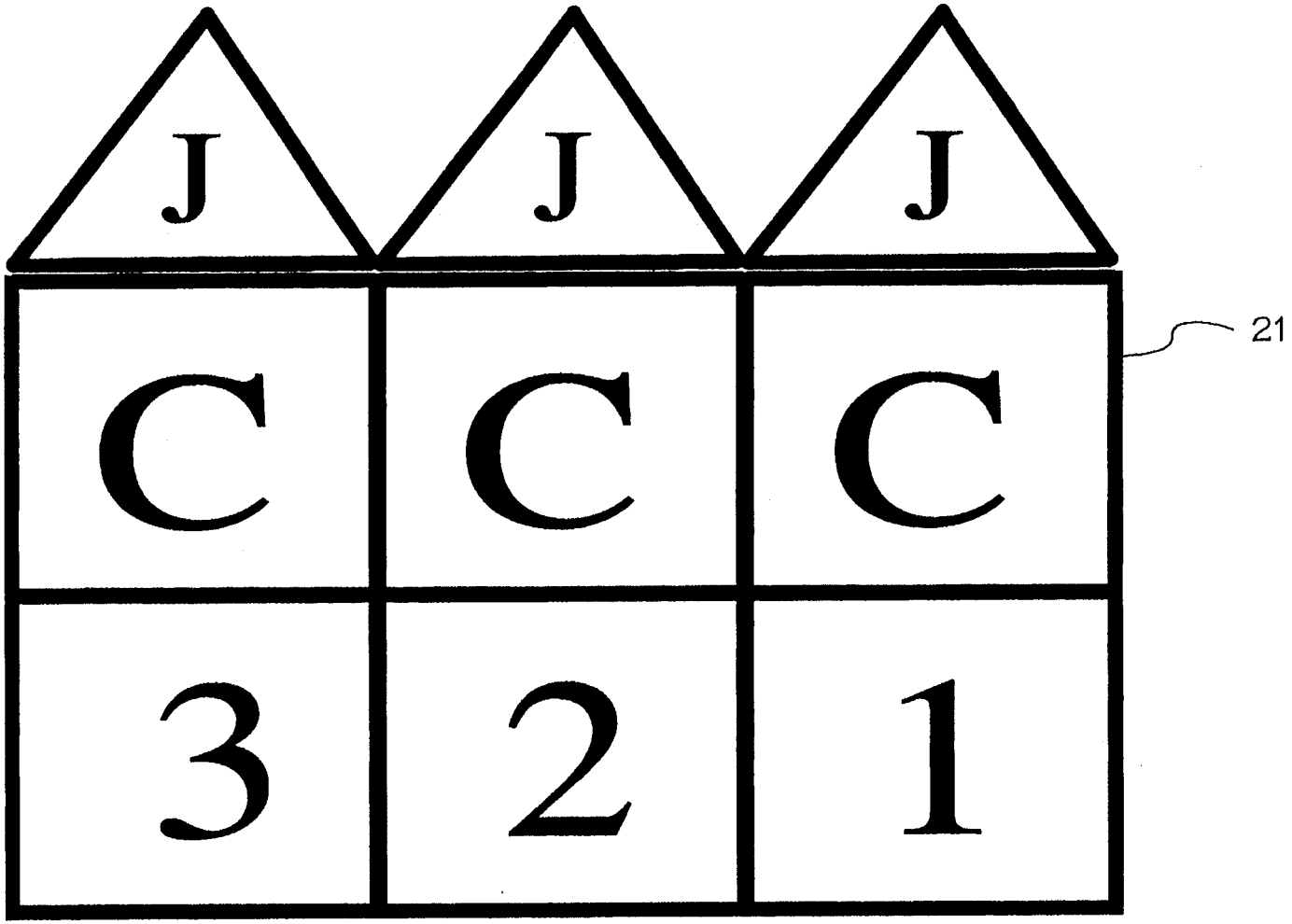
FIG. 2 is an enlarged view of the placement of the wagering, collection and jackpot positions of the playing surface of FIG. 1.

In front of each player position 1–8, there is a grouping 21–28, respectively, of geometric symbols (See also FIG. 2). A line 30 separates the dealer from the players and cards are played in position intermediate line 30 and the dealer block 17*a*. The spacing and dimension is such that the card playing area is out of reach of a seated player. As shown in FIG. 2, such as in grouping 21, there are typically for each grouping three rows of three columns of symbols comprising two squares and a triangle, with the triangle being nearest the dealer position 17*a* and labeled "J" for "jackpot." The squares nearest the player position are betting squares designated "1," "2," and "3," with the intermediate squares being designated "C" for "collection." There is a "J" triangle and a "C" square associated with each of the number squares "1", "2" , and "3".

Each player seated at the table 15 places his bet in the appropriate "square 1" , with the other two squares "2" and "3" being available for backline player betting. Player 1 (grouping 21) also uses "C" and "J" symbols in alignment with "square 1" for collection and jackpot purposes. The concept of "collection" and "jackpot" is described hereinbelow. In a preferred embodiment, the deck for playing "Ultra 9" cards consists of four suits, that is, spades, hearts, clubs and diamonds, for example, of cards as follows:

| QUANTITY | CARD | VALUE |
|---|---|---|
| 48 | King | 0 |
| 48 | Queen | 0 |
| 48 | Jack | 0 |
| 48 | Ace | 1 |
| 48 | 2 | 2 |
| 48 | 3 | 3 |
| 48 | 4 | 4 |
| 48 | 5 | 5 |
| 48 | 6 | 6 |
| 4 | 9 | 9 |

In the last column above labeled "Value" this is the point count of each particular card on play of the hands for determination of winning, that is, achieving a total count of nine or less. For automatic shufflers, 24 cards of each value (and two 9's) should be used. This would not significantly effect the mathematics of the game. The game is designed to give a small advantage to the banker. The advantage should be enough so as to give players incentive to take the bank, but not large enough to give the banker significant odds to make money at the expense of the other players, or to dissuade players from betting against the banker.

Although the deck preferably has the composition shown in the above table, variations of numbers (but not of card values) may be utilized.

If desired, the size of the banker's advantage can be adjusted by changing the number of nines in the deck. The following table shows the bank's advantage for other deck compositions.

| Number of 9's | Bank's Edge |
|---|---|
| 0 | 0.8% |
| 2 | 1.0% |
| 4 | 1.4% |
| 8 | 1.9% |
| 12 | 2.3% |
| 16 | 2.9% |
| 32 | 4.6% |
| 48 | 6.3% |

THE PLAY OF THE GAME

1. A banker is selected (as previously described), and the "bank" wager is placed.

2. Each player puts out his/her bet on the appropriate square. Only one person should bet on each of the Squares 1–3 of a grouping 21–28, that is, three bets are allowed per grouping. The chips are in an area far enough from the players that there is no opportunity to touch the chips once the betting is closed.

3. Each player (seated or backline) places the collection (in accordance with casino rules) in a separate square "C" associated with his or her betting position, that is, the "C" square immediately above the player's square. The player who is in the chair at player position 1 bets in Square 1 of grouping 21 and will make decisions on how to play the hand to the exclusion of backline players playing in the same grouping 21. Collections placed in square "C" are gathered by the dealer before the cards are dealt.

4. Each player who wishes to make a jackpot bet places his bet in the triangle "J" associated with his appropriate betting square. The concept of "jackpot" will be described hereinafter.

5. Dice are shaken in a cup to determine the order of payoffs of the players from the bank. Once the dice are shaken, players may not touch their chips.

6. Each player is dealt three cards. All cards are dealt face up except for the banker's hand which is dealt two cards up and one card down. The dealer places the banker's cards in front of him (the dealer) and asks the banker which two cards to turn face up. The dealer turns those cards over. As previously stated, the cards are dealt in the area between the dealer block 17*a* and the separation line 30. The players are not allowed to touch their cards.

7. The jackpot bets are gathered for the house after the dealer determines whether there is a jackpot.

8. At this point, each player in turn can "surrender" his hand and half his bet. The other half is returned to him. A player surrenders by verbal declaration. The dealer settles the bet by placing half the bet in the back collection square "C" and the other half in the front betting Square 1, and placing a surrender button on the front portion. In case it is not possible to divide the bet equally, the larger portion of the bet is surrendered to the banker. Other bettors on this hand may continue to play. If the player with the bet in Square 1 surrenders, and backline bets have been placed in at least one of the other betting squares associated with the grouping, the hand must be hit. In case of surrender by a player, the house is under no obligation to return the collection associated with the surrendering player. The amount surrendered is not part of the bank for settling bets with other players.

9. If the dealer determines that a jackpot or a natural 9 is possible, the dealer checks the banker's hole card. (A NATURAL 9 is any THREE-CARD hand with a value of nine.) There are special attributes for three 3's and even more so for three 3's of the same suit. If the banker has a natural 9, all bets are collected, except for surrendered hands and other players with natural nines, to the extent the bank money covers.

10. If the banker does not have a natural nine, each seated player has three options:

DOUBLE the bet and take a card
STAND
HIT

If the player "doubles," he places in his Square a wager up to the original amount and draws a card. The new card is dealt face down and remains untouched until the end of the action.

A player doubles by verbal declaration. The dealer moves the original bet forward from the player's betting square, and then the player puts out the additional bet. The player does not touch the original bet.

In case of a second bet, the player pays no additional collection. If the seated player doubles, backline players may also double, but are not required to do so. A player can only double if the declarer, or seated player, has three cards showing. a total of 0, 1, 2, 3, or 4.

If the player "stands," he draws no card and his hand is complete.

If the player "hits," he is dealt one card face down, and the face down card remains untouched until the end of the action.

Except as explained above, all decisions are made by the seated player with the bet in betting Square 1.

11. After all the players have acted, the banker's down card is turned over by the dealer, and the banker can hit or stand. If he hits, his last card is dealt face up.

12. The dealer settles each hand, in order, to the extent that banker's money covers the bets.

THE DEALER turns over any face-down cards. The hand is added up. Face cards count as zero and ACES count for one. All other cards have their face value. Totals over ten are reduced by 10, 20 or 30, etc., so that their final value is between 0 and 9.

The player's hand is compared to the banker's hand with the hand at, or closest to, nine being the winner.

If the banker has a natural nine (no hit was made), this beats anything except another natural nine.

In case of ties, no money changes hands. Ties will occur less than 11% of the time.

If there is insufficient money in the bank to cover at least half of any player's bet, that player is given a "Free Play" button, which is good for his next collection.

JACKPOT GAMES

Jackpots are very popular in most card games. The card game described herein in accordance with the invention lends itself to such jackpot games. In a jackpot game, the player has the opportunity to win a very large sum of money on any hand, thus making the game more exciting. The card game in accordance with the invention can be played with either or both of two types of jackpots, an Easy Jackpot and a Super Jackpot, with jackpot prizes in amounts corresponding to difficulty.

By way of example, a $5000 Easy Jackpot is relatively easy to hit and plays a smaller amount. The more difficult, progressive, Super Jackpot will be hit substantially less often and will pay a larger amount. A Super Jackpot can start at $50,000 and increase in size by all or part of the amount of money players bet in the "J" box until it is hit.

Players do not have to play for a jackpot. The jackpot is an optional side bet of a given amount, for example one dollar. This means that separate tables are not necessary for jackpot and non-jackpot games.

Any player, including the banker can place a one dollar bet on his/her jackpot triangle "J." A player can only collect on a jackpot if he has made this bet in the jackpot triangle. A player cannot make the jackpot bet unless he is betting a hand and paying a collection.

The jackpot is split between the player with the jackpot hand and the banker. The player gets 80% of the total jackpot and the banker gets 20%. If either did not make a $1 jackpot bet, their portion is not paid, but the other portion is paid.

Since a California casino cannot legally bank a game, all money paid into the jackpot fund, except for a management fee for the casino, would be paid back to the players.

To hit the Easy Jackpot, the player, other than the banker, must be dealt a natural 9 consisting of three 3's of the same suit. This will happen around once every 15,589 hands dealt. If jackpot collection is $1, this would pay $4000 to the player and $1000 for the banker.

To hit the Super Jackpot, the player must be dealt a natural 9 consisting of three 3's of the same suit and the banker must also be dealt a natural 9. This will happen roughly once every 187,800 hands dealt. This means that an average Super Jackpot could be over $100,000.

If there are six players at a typical table, and 30 hands per hour are played, an Easy Jackpot would be hit about once every four days. A player who played eight hours per week would hit one every 15 months. If there are six players at a typical table, and 30 hands per hour are played, a Super Jackpot would be hit about once every three years. Naturally, if there were more tables, the jackpots would be hit more often.

The banker gets a smaller portion of the jackpot, since he has a greater chance of hitting one. On a table with six players, the banker can be involved in a jackpot with any of the five other players and will hit five times as many jackpots as any player.

The card game according to the invention is well suited to jackpots, since it would be much more difficult to rig a jackpot, as in certain Asian games, and far more secure than conventional poker games. The following measures would be used to guarantee jackpot security:

All cards are dealt from a shoe which is prepared in advance in a card control room. The dealer would be instructed to deal the cards in a way to make palming cards impossible. The dealer scrambles the cards when a new shoe is put into play, and when a shoe has been completed, it is returned to the card control room.

Before the first hand is dealt, the dice cup is shaken, and the number of the dice determines how many cards are burned or buried.

The players never touch the cards. All cards related to the jackpot are dealt face up except for the banker's hole card, which is turned over by the house dealer.

When a jackpot is hit, the deck should be counted down with appropriate management attendance in front of the players.

The card game hereinbefore described is thus relatively easy to learn to play and has inherent safeguards against cheating.

By comparison to other known gambling type games, the following table illustrates certain comparison criteria.

| | Comparison to Other Games | | | | |
|---|---|---|---|---|---|
| | Ultra 9 Cards | Pai Gow Tiles | Pai Gow Poker | Super Pan 9 | 22 |
| Easy to Learn | Yes | No | Yes | Yes | Yes |
| Interesting Decisions | Yes | Yes | Yes | No | Yes |
| Number of Pushes | Moderated (11%) | Very High | High | Moderate | Low |
| Cheating Potential | Extremely Low | High | High | Moderate | High |
| Hands per Hour | 40 | 20 | 20 | 28–30 | 20 |
| Automatic Shuffler Compatible | Yes | N/A | No | No | No |
| Jackpot | Yes | Possible | Possible | Possible | Possible |
| Surrender | Yes | No | No | No | No |

-continued

| | Comparison to Other Games | | | | |
|---|---|---|---|---|---|
| | Ultra 9 Cards | Pai Gow Tiles | Pai Gow Poker | Super Pan 9 | 22 |
| Option Hit/Stand Double | Yes | No | No | No | No |
| Option Jackpot (2-tiered payoff) | Yes | No | No | No | No |
| Adj. Bank Edge | Yes | No | No | No | No |

Pai Gow Tiles is difficult to learn for most people, since the values of the tiles have to memorized first. After that, there is moderate complexity in playing decisions. There is a relatively high number of pushes, leading to the lowest standard deviation of any casino game played in California. Only 20 hands per hour can be dealt.

Pai Gow Tiles is extremely difficult to protect, both from the outside and the inside. If the house allows more than one player to handle the tiles, the tiles can be passed or switched outside the view of the security camera. As with cards, tiles can be marked and manipulated.

The version of Pai Gow with cards (Pai Gow Poker) is easy to learn for anyone who knows how poker hands are ranked. Like all the card games, it has a far wider appeal as most people are more familiar with playing cards than the dominoes and there are no special combinations to memorize. Although allowing only one player to handle the cards limits some forms of cheating, card manipulation and marking still make cheating hard to control. However, only 20 hands per hour can be dealt.

Super Pan 9 is a variation of Baccarat, modified for California. It is extremely easy to learn and there is virtually no strategy. Cheating is less prevalent than in most other games, but is still possible. It is possible to deal 28–30 hands per hour. However, frequent "card squeezing" makes automatic shufflers difficult to use.

"22" is a variation of blackjack and generally has the same advantages and disadvantages.

The card game of the present invention is a hybrid of blackjack and baccarat, but California legal. It is similar enough to Blackjack and Pan 9 in that it is very easy to learn.

This game can also be utilized by Nevada casinos where the house would choose to bank the game. To allow a house dealer to run the game, it would be necessary to have the house play the dealer's hand in a simple, automatic way. By way of example, the rules could be that the dealer hits on five or less, and stands on six or more.

In accordance with the present invention, there has been shown and described a card game which is fast action and fun, and is simple enough to master in minutes, yet challenging enough to keep the player interested for years. The decisions are not complex, but there are enough decisions to keep the player involved. Wagering stakes change hands on virtually every hand.

With only the dealer handling the cards, the possibility of cheating is minimized. The players never handle the cards. All cards are dealt face up or turned over by the dealer. After the initial bet, the players never touch the chips. Additional bets are made on a different part of the table.

The game is designed to give each player a fair chance at winning. No player can get enough of an edge to guarantee consistent winning at the cost of the other players.

While there has been herein shown and described a preferred embodiment, it is to be understood that various other adaptations and modifications may be made within the spirit and scope of the invention.

What is claimed is:

1. A method of playing a card game comprising:

providing a deck of cards consisting of a like number of each Ace through 6, Jack, Queen and King, and a plurality of cards having face value of 9, said plurality of 9's not exceeding said number;

establishing values for each card, the values being Ace-1, King-0, Queen-0, Jack-0, and all other cards keeping their face value;

dealing three cards to each player;

providing each player, in turn, the opportunity to select one of (a) draw an additional card or (b) stand with the dealt cards; and determining the winners based on the total value being at or near nine.

2. The method of claim 1 further including establishing a banker, said banker providing a wager against which the other players bet.

3. The method of claim 2 further including providing to each player after the deal of the initial cards, the additional option to surrender, in which event the surrendering player retains one-half his bet.

4. The method of claim 3 further including providing to each player after the deal of the initial cards, the additional option to double, by adding an increment or bet equal to the original bet, and draw an additional card, but only if the player has a total card value of four or less.

5. The method of claim 2 further including providing to each player after the deal of the initial cards, the additional option to double, by adding an increment or bet equal to the original bet, and draw an additional card, but only if the player has a total card value of four or less.

6. The method of claim 1 including the step of immediately paying any player, or banker, having a hand value of nine on the first three cards dealt, unless both the player and the banker have a hand value of nine on the first three cards dealt.

7. The method of claim 1 further including establishing a wager against which the players bet.

8. The method of claim 7 further including providing a jackpot above said wager, with each of said players being entitled to place an additional bet toward said jackpot, and paying said jackpot to those players having three 3's of the same suit as their first three cards.

9. A method of playing a wagering card game comprising:

providing a deck of cards consisting of a like number of each of Ace through 6, Jack, Queen and King, and a plurality of cards having face value of 9, said plurality of 9's not exceeding said number;

establishing values for each card, the values being Ace-1, King-0, Queen-0, Jack-0, and all other cards keeping their face value;

selecting from a group of players, a banker, said banker providing a wager against which the other players bet;

prior to deal of the cards, establishing an order of payoff among the other players from the proceeds of said wager at the conclusion of the hand of cards;

dealing three cards face up to each player and dealing three cards to said banker, one of which is face down and the others of which are face up;

providing each player and said banker, in turn, the opportunity to select one of (a) draw an additional card, (b) stand with dealt cards, (c) surrender, in which event the surrendering player retains one-half his bet and surrenders the other half to the banker, or double by adding an increment of bet equal to the original bet, and drawing an additional card, but only if the player has a total card value of four or less;

determining the winners based on the total value of a hand being at or near nine; and paying from said wager the bets of winning players and paying to the banker the losing bets of the players.

10. The method of claim 9 wherein said number of said deck of cards is 48 and said plurality of 9's is 4.

11. The method of claim 10 wherein said number of said deck of cards is 24 and said plurality of 9's is 2.

12. The method of claim 10 wherein said cards are divided among four suits, and further including the step of instantly paying a player or banker having a hand value of 9 on the first three cards dealt, unless both the player and the banker have a hand value of 9 on the first three cards dealt.

13. The method of claim 9 further including providing a playing surface having indicia thereon for deposit of a wager by a player and separate indicia thereon for deposit of a collection fee for the game provider.

14. The method of claim 9 wherein the rules of the game prohibit contact with the cards by anyone other than the dealer.

15. A method of playing a card game comprising:

providing a deck of cards consisting of a like number of each of Ace through 6, Jack, Queen and King, and a plurality of cards having face value of 9, said plurality of 9's not exceeding said number;

establishing values for each card, the values being Ace-1, King-0, Queen-0, Jack-0, and all other cards keeping their face value;

providing a playing surface having indicia thereon for deposit of a bet by a player and separate indicia thereon for deposit of a collection fee for the game provider;

dealing three cards to each player at locations on said playing surface out of reach of the players;

providing each player, in turn, the opportunity to select one of (a) draw an additional card or (b) stand with dealt cards; and determining the winners based on the total value of a hand being at or near nine.

16. The method of claim 15 wherein said playing surface further includes indicia thereon for a jackpot and each of said players is provided with an option to place an additional predetermined bet in said jackpot indicia.

17. The method of claim 16 wherein the jackpot is paid to one or more players having three 3's of the same suit as their first three cards dealt.

18. The method of claim 15 wherein said playing surface further includes indicia arranged in groups whereby one or more others may place bets in the indicia of a given group associated with a given player.

19. The method of any one of claims 15 through 18 further including establishing a banker, said banker providing a wager against which the other players bet.

20. The method of claim 18 including, prior to the commencement of a game, of selecting a number of nines for the deck of cards whereby to control the banker's advantage during play.

21. The method of claim 18 including paying one jackpot amount when a player has three 3's of the same suit as his first three cards and a larger amount when the banker also has a hand value of nine on his first three cards.

22. The method of claim 15 further providing to each player after deal of the initial three cards, the additional option to surrender, in which event the surrendering player retains one-half his bet.

23. The method of claim 15 or 22 further compromising providing to each player after deal of the initial three cards, the additional option of double by adding an increment of up to the original bet, and drawing an additional card.

24. The method of any one of claims 15 through 23 including the step of immediately paying any player, or bander, having a hand value of nine on the first three cards dealt, unless both the player and the banker have a hand value of nine on the first three cards dealt.

25. The method of claim 15 further including establishing a bank wager against which the others bet.

26. A deck of cards for a casino game in which each player is initially dealt three cards with the objective being for the player to have a total hand value, after play, of nine or less, said deck consisting of a like number of each of Ace through 6, Jack, Queen and King, and a plurality of cards having face value of 9, said plurality of 9's not exceeding said number, with the Ace through 6, and 9 having card values of 1 through 6 and 9, respectively, and the face cards having zero value.

27. The deck of cards of claim 26 wherein there are four 9's and 48 of each of the other cards.

28. The deck of cards of claim 27 wherein there are 48 of each of the cards Ace through 6, King, Queen and Jack, and a number of 9's between 2 and 48.

* * * * *